US011446533B1

(12) United States Patent
Xu

(10) Patent No.: US 11,446,533 B1
(45) Date of Patent: Sep. 20, 2022

(54) SWINGING HULA HOOP

(71) Applicant: Quanzhou Zhonglong Information Technology Co., Ltd., Quanzhou (CN)

(72) Inventor: Gangzhong Xu, Quanzhou (CN)

( * ) Notice: Subject to any disclaimer, the term of this patent is extended or adjusted under 35 U.S.C. 154(b) by 0 days.

(21) Appl. No.: 17/412,288

(22) Filed: Aug. 26, 2021

(30) Foreign Application Priority Data

Jul. 27, 2021 (CN) ..... 202110851014.4

(51) Int. Cl.
*A63B 19/00* (2006.01)
*A61H 15/00* (2006.01)

(52) U.S. Cl.
CPC ..... *A63B 19/00* (2013.01); *A61H 15/00* (2013.01); *A61H 2015/0014* (2013.01); *A61H 2201/1261* (2013.01); *A61H 2201/1695* (2013.01)

(58) Field of Classification Search
CPC ..... A61H 15/00; A61H 2015/0014; A61H 2201/1261; A61H 2201/1695; A61H 2201/005; A63B 19/00; A63H 33/02; A63H 33/062
USPC ..... 446/26, 28, 236
See application file for complete search history.

(56) References Cited

U.S. PATENT DOCUMENTS 5,458,561 A * 10/1995 Schweisfurth ..... A61H 15/0092 601/119
5,848,980 A * 12/1998 Demerais ..... A61H 23/02 601/46
6,231,420 B1 * 5/2001 Lin ..... A61H 39/08 446/236
6,319,086 B1 * 11/2001 Shen ..... A63B 19/00 446/236
D458,651 S * 6/2002 Lee ..... A63H 33/02 D21/457
D937,357 S * 11/2021 Ju ..... D21/457
11,173,336 B1 * 11/2021 Xu ..... A63B 21/0602
2006/0172657 A1 * 8/2006 Chen ..... A63H 33/02 446/236
2007/0017072 A1 * 1/2007 Serio ..... B25G 3/18 24/573.11
2008/0010868 A1 * 1/2008 Tsai ..... A43B 1/0081 36/141
2011/0257569 A1 * 10/2011 Robins ..... A61H 15/00 601/137
2013/0289454 A1 * 10/2013 Wang ..... A61H 15/00 601/132
2019/0262220 A1 * 8/2019 Smith ..... A61H 23/0263
2021/0252323 A1 * 8/2021 Lu ..... A61H 7/002

* cited by examiner

*Primary Examiner* — Colin W Stuart
*Assistant Examiner* — Douglas Y Sul

(57) ABSTRACT

The present invention discloses a swinging hula hoop, including a hula hoop body, the hula hoop body including a plurality of connecting pieces detachably connected end to end, and a side of the connecting piece close to the waist of a human body being provided with a first kneading device configured to transversely knead and massage the waist of the human body when the hula hoop is used; the first kneading device includes: a roller carrier provided on the side of the connecting piece close to the waist of the human body; and at least one first massage roller rotatably provided on the roller carrier and configured to transversely knead and massage the waist of the human body.

8 Claims, 9 Drawing Sheets

SWINGING HULA HOOP

CROSS-REFERENCE OF RELATED APPLICATIONS

The present application claims the benefit of Chinese Patent Application No. 202110851014.4, entitled "Swinging Hula Hoop", filed on Jul. 27, 2021, in the China National Intellectual Property Administration, the entire content of which is incorporated herein in its entirety.

TECHNICAL FIELD

The present invention relates to the field of fitness equipment technologies, and in particular to, a swinging hula hoop.

BACKGROUND

A hula hoop is also called a fitness hoop, and rapidly becomes a sports item suitable for people of all ages due to portability, attractiveness and a small occupied area for exercise activities. A user continuously rotates the hula hoop at the waist by twisting the waist, and a skilled person may obtain better movement and development of waist and abdomen muscles, hip muscles and leg muscles, thus effectively improving a mobility and a flexibility of the waist joint, the hip joint and the knee joint of a human body.

However, the conventional hula hoop is difficult to rotate continuously for a beginner who does not master the special skill, which undoubtedly increases a difficulty of the beginner in using the hula hoop; moreover, since a body of the hula hoop is greater than the human body, when the user stops rotating the hula hoop, the hula hoop may fall off, such that the feet of the user are prone to injury, and a certain potential safety hazard is brought to the user.

Therefore, Chinese Patent Application No. CN202110205433.0 discloses a hula hoop, including a plurality of first connecting assemblies, a second connecting assembly and a counterweight assembly, the plural first connecting assemblies and the second connecting assembly being sequentially and detachably connected end to end, so as to form an annular hula hoop body. Since the plural first connecting assemblies and the second connecting assembly are detachably connected into the annular hula hoop body, the user may adjust a number of the first connecting assemblies according to actual use requirements, such that a size and a length of the hula hoop body better fit the user; connections between the first connecting assemblies and between the first and second connecting assemblies have adjustable angles, so as to realize a shape of the hula hoop body more suitable for the waist of the user; each of the first and second connecting assemblies is provided with a damping assembly, and the plural damping assemblies are arranged at an inner circumference of the hula hoop body to better fit the waist of the user, thus improving comfort of utilization of the hula hoop by the user; the counterweight assembly slides in an annular slide way following an action of the user, thereby improving a counterweight feeling of the user.

However, the hula hoop does not have a function of pressing the waist of the human body to promote waist exercise in a rotation process of the conventional hula hoop. Although the hula hoop has the function of pressing the waist of the human body to promote the waist exercise to a certain extent by massaging the waist of the human body using a plurality of protrusions arranged on the damping assembly, the pressing action is only limited to pressing the same position, a massage effect is not obvious, and therefore, there exists a need for a hula hoop capable of enhancing the massage effect on the waist of the human body and improving a usability of the hula hoop.

SUMMARY

Therefore, in order to solve the above-mentioned problems, the present invention provides a swinging hula hoop.

In order to achieve the above-mentioned object, the technical solution of the present invention provides a swinging hula hoop, including a hula hoop body, the hula hoop body including a plurality of connecting pieces detachably connected end to end, and a side of the connecting piece close to the waist of a human body being provided with a first kneading device configured to transversely knead and massage the waist of the human body when the hula hoop is used.

In some embodiments, the first kneading device includes: a roller carrier provided on the side of the connecting piece close to the waist of the human body; and at least one first massage roller rotatably provided on the roller carrier and configured to transversely knead and massage the waist of the human body.

In some embodiments, the first massage roller is provided with a plurality of massage protrusions.

In some embodiments, a damping device configured to absorb shocks when the kneading device transversely kneads and massages the waist of the human body is provided between the roller carrier and the connecting piece.

In some embodiments, the damping device includes: an accommodating groove provided at the connecting piece and configured to be slidably connected with the roller carrier; and an elastic part provided in the accommodating groove, located between the roller carrier and the accommodating groove and configured to absorb the shocks when the kneading device transversely kneads and massages the waist of the human body.

In some embodiments, a damping limiting device configured to prevent the roller carrier from being separated from the accommodating groove when the roller carrier slips outwards in the accommodating groove is provided between the accommodating groove and the roller carrier.

In some embodiments, the damping limiting device includes: a limiting block fixedly provided on the roller carrier and configured to prevent the roller carrier from being separated from the accommodating groove when the roller carrier slips outwards in the accommodating groove; and a limiting hole formed in the accommodating groove and configured to be fitted with the limiting block for limitation.

In some embodiments, a through arc-shaped chute is formed in a side of the connecting piece apart from the waist of the human body in a circumferential direction thereof, the plural arc-shaped chutes are connected end to end, so as to form an annular chute, and a counterweight device is slidably connected on the hula hoop body at the annular chute.

In some embodiments, the counterweight device includes: a counterweight connecting piece slidably provided on the hula hoop body at the annular chute; a sliding part provided on the counterweight connecting piece and configured to drive the counterweight connecting piece to slide and displace on the hula hoop body at the annular chute; a counterweight assembly detachably connected with the counterweight connecting piece; and at least one second kneading device detachably provided at an end of the connecting piece close to the waist of the human body, and configured to transversely knead and massage the waist of the human body when the counterweight connecting piece slides on the hula hoop body at the annular chute.

In some embodiments, the second kneading device includes: a connecting frame provided at the end of the counterweight connecting piece close to the waist of the human body; and a second massage roller rotatably provided on the connecting frame.

In some embodiments, the second massage roller is provided with a plurality of massage protrusions.

In some embodiments, the sliding part includes: a slippage connecting block provided on the counterweight connecting piece and configured to extend into the hula hoop body from the annular chute; and a rotating wheel set rotatably provided on the slippage connecting block and configured to abut against the hula hoop body to drive the counterweight connecting piece to slide on the hula hoop body at the annular chute.

In some embodiments, the rotating wheel set includes: at least one inner rotating wheel set symmetrically provided on the slippage connecting block and configured to abut against an inner wall of the hula hoop body to rotate; and at least one outer rotating wheel set symmetrically provided on the slippage connecting block and configured to abut against an outer wall of the hula hoop body to rotate.

In some embodiments, a connecting-piece limiting device is provided between every two adjacent connecting pieces, and the connecting-piece limiting device includes: two limiting plates provided at one end of the connecting piece and located on two sides of the arc-shaped chute respectively; and two limiting grooves provided at the other end of the connecting piece and located on the two sides of the arc-shaped chute respectively.

In some embodiments, every two adjacent connecting pieces are detachably connected by an engagement connecting device or a quick-release connecting device.

In some embodiments, the engagement connecting device includes: two hinged columns provided at one end of the connecting piece; and two hinged grooves provided at the other end of the connecting piece and configured to be fitted and connected with the two hinged columns.

In some embodiments, the quick-release connecting device includes: two engaging blocks provided at one end of the connecting piece; and two quick release buttons provided at the other end of the connecting piece and configured to be fitted and connected with the two engaging blocks respectively.

In some embodiments, the quick release button includes: a button groove provided at the connecting piece; a through hole provided at a bottom of the button groove; a button slidably provided at the button groove and located at the through hole; a return spring provided between the button groove and the button and configured to lift and return the button after the button is pressed; and a button limiting device provided between the button groove and the button and configured to prevent the button from being separated from the button groove when the button slips outwards in the button groove; a periphery of the through hole is provided with an annular guide plate configured to guide the button sliding on the through hole.

In some embodiments, the button includes: a button column slidably provided at the button groove and located at the through hole; a button block fixedly provided at an upper end of the button column; and an engaging groove provided at the button column and configured to clamp the engaging block into the button column after the button is pressed.

In some embodiments, the button limiting device includes: two button limiting parts provided at a bottom of the button block and located at the button column; and button limiting holes formed in two side walls of the button groove and configured to be fitted with the two button limiting parts, the button limiting part including a limiting connecting plate provided at the bottom of the button block and a limiting projection provided at the limiting connecting plate and configured to be fitted with the button limiting hole.

The swinging hula hoop according to the present invention has the following beneficial effects.

1. In the present invention, by providing the first kneading device, when using the hula hoop, a user twists the waist to contact the first massage roller, thus forming a pressing type massage on the waist of the human body, so as to achieve an effect of promoting waist exercise; meanwhile, the first massage roller rotates on the roller carrier due to the contact of the waist of the user, thus forming a transverse kneading type massage on the waist of the human body, so as to enhance an exercise effect; in addition, the massage protrusion further enhances a massage effect on the waist of the human body, and increases a friction force during contact with the human body, such that the first massage roller is easier to rotate on the roller carrier, the massage effect is better, and meanwhile, an antislip effect is achieved, thus preventing the hula hoop from falling off in use of the user.

2. In the present invention, by providing the damping device, when the user uses the hula hoop and twists the waist to contact the first kneading device, the elastic part is provided to reduce shocks, thus reducing a pressure of the waist of the human body in contact with the first kneading device in a large-force twisting process, preventing injury of the waist of the human body caused by an excessive force during contact with the first kneading device, and enhancing a use safety of the user.

3. In the present invention, by providing the damping limiting device, the limiting block and the limiting hole in the damping limiting device are fitted for limitation, thus preventing the first kneading device from being separated from the connecting piece in a use process, guaranteeing normal use of the damping device, and improving the use safety of the user.

4. In the present invention, by providing the second kneading device, when the user uses the hula hoop and twists the waist, the counterweight device slides in the annular chute following the action of the user, the second kneading device in the counterweight device also moves around the waist of the user with the counterweight device, and the second massage roller continuously massages the waist of the user, thus enhancing the massage effect.

5. In the present invention, the inner rotating wheel set is fitted with the outer rotating wheel set, such that the counterweight connecting piece may better fit and slide on the hula hoop body, and an anti-falling effect is achieved.

6. In the present invention, the connecting-piece limiting device is provided, such that every two adjacent connecting pieces may be better aligned when connected, so as to achieve a connection assisting effect; meanwhile, rotation between the two adjacent connecting pieces is limited to prevent an influence on use caused by deformation of the whole hula hoop due to an overlarge rotation amplitude, such that when the hula hoop rotates, the two adjacent connecting pieces have a smaller gap, and due to the small gap, a rotation sound is smaller, and the rotation is smoother, thus improving use experiences of the user.

DETAILED DESCRIPTION

Implementations of the present invention will be further described hereinafter in combination with accompanying drawings and embodiments. The following embodiments are only for more clearly illustrating the technical solutions of the present invention, and the protection scope of the present invention is not limited thereby.

Figure 1:
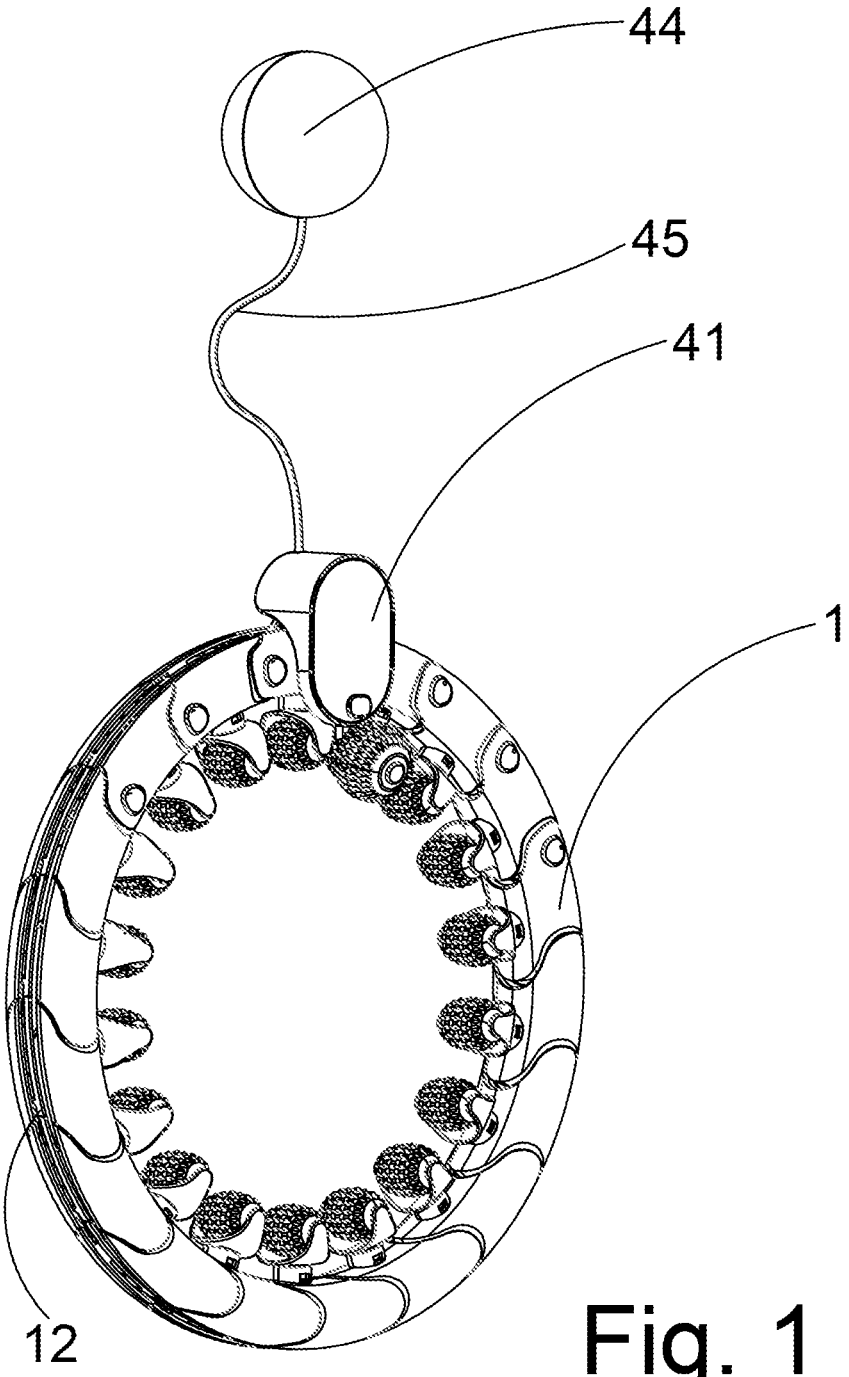
FIG. 1 is a schematic structural diagram of a swinging hula hoop according to an embodiment of the present invention.
Figure 2:
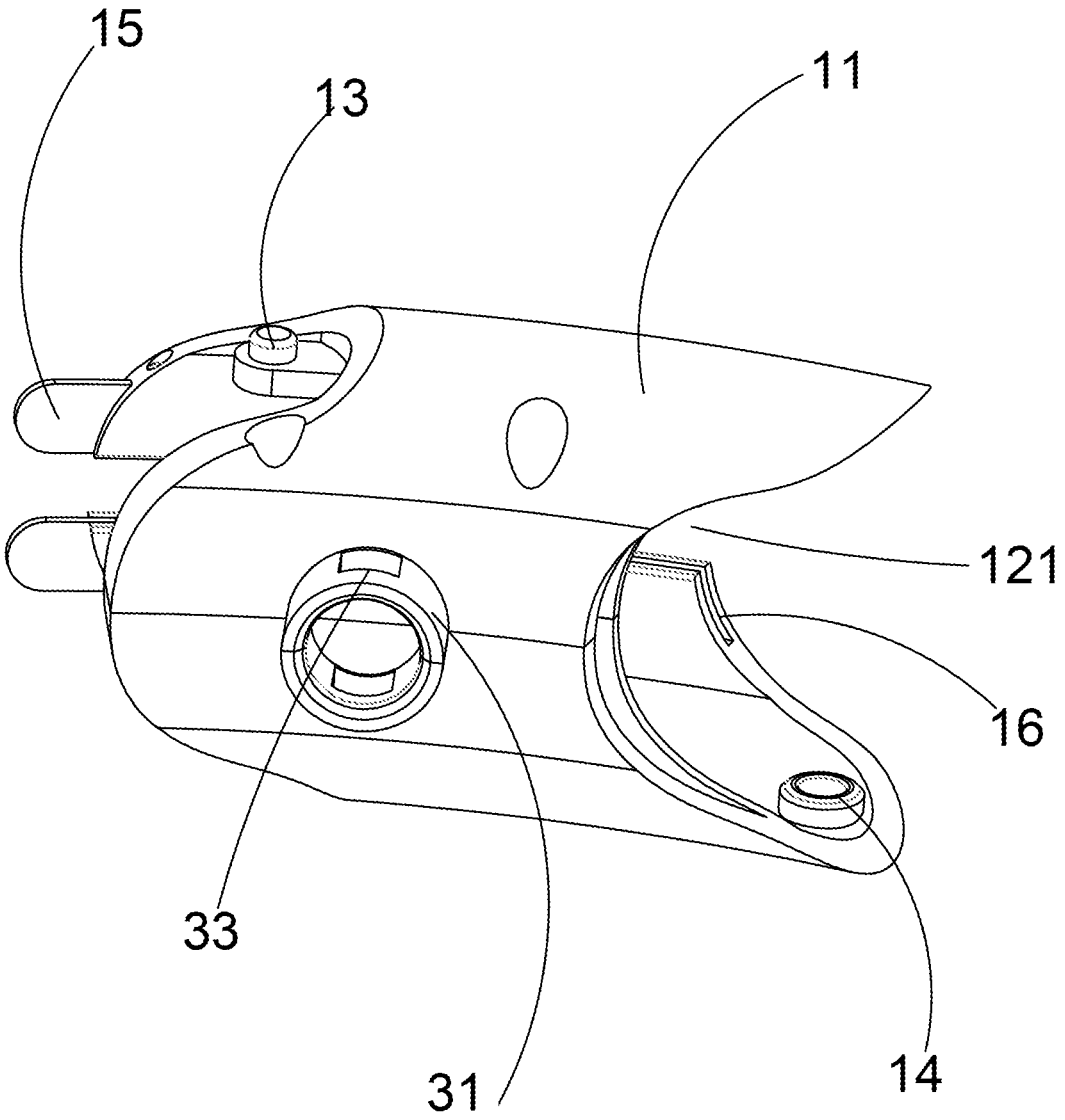
FIG. 2 is a schematic structural diagram of a connecting piece according to the embodiment of the present invention.
Figure 3:
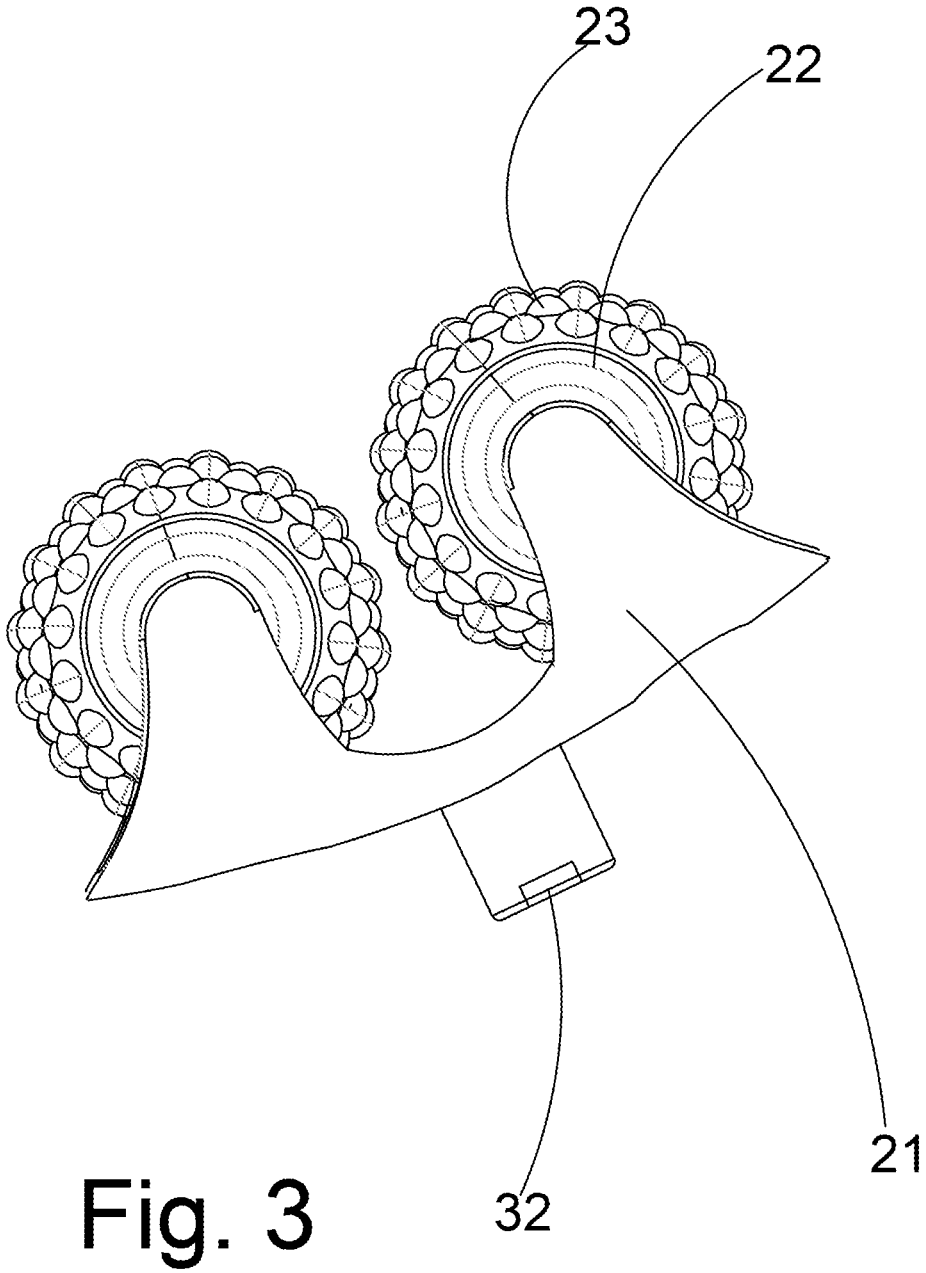
FIG. 3 is a schematic structural diagram of a first kneading device according to the embodiment of the present invention.
Figure 4:
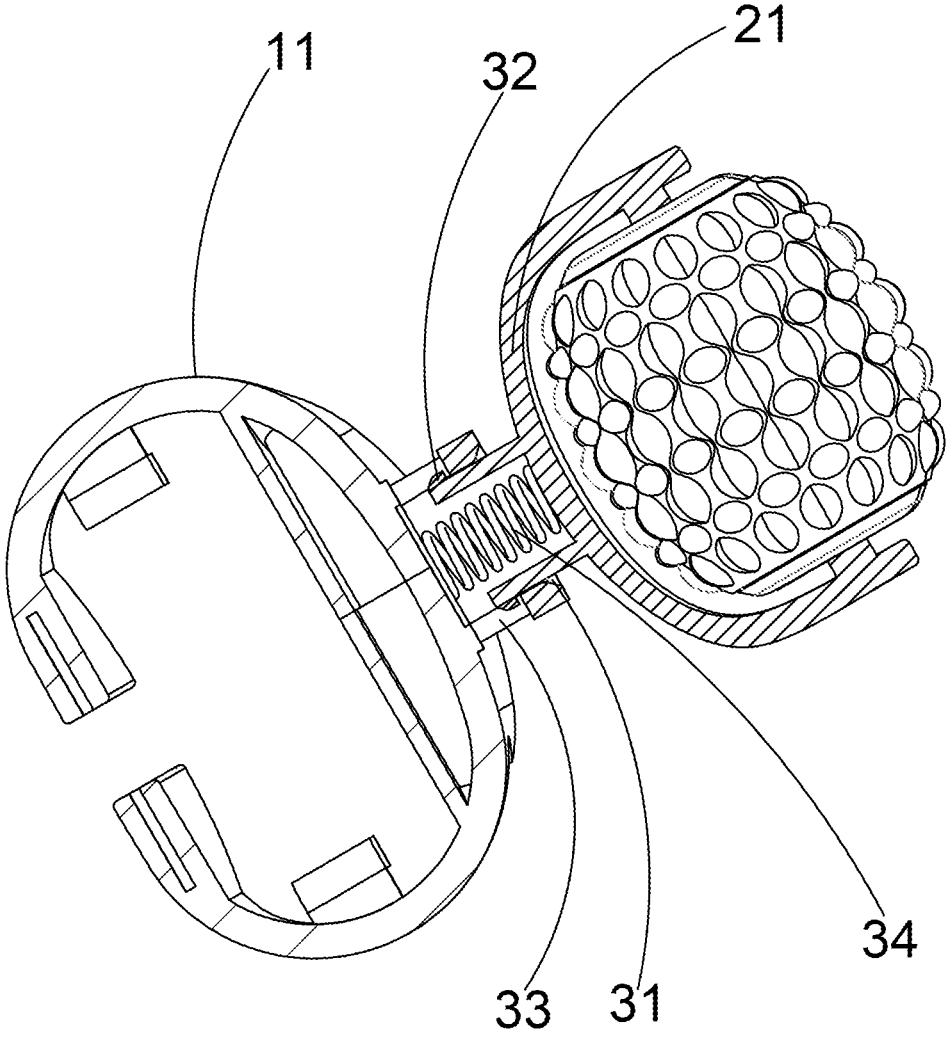
FIG. 4 is a schematic sectional structural diagram at a damping device according to the embodiment of the present invention.

Referring to FIGS. 1 to 9, a swinging hula hoop includes a hula hoop body 1, the hula hoop body 1 including a plurality of connecting pieces 11 detachably connected end to end, and a side of the connecting piece 11 close to the waist of a human body being provided with a first kneading device configured to transversely knead and massage the waist of the human body when the hula hoop is used. The first kneading device includes: a roller carrier 21 provided on the side of the connecting piece 11 close to the waist of the human body; and at least one first massage roller 22 rotatably provided on the roller carrier 21 and configured to transversely knead and massage the waist of the human body. The first massage roller 22 is provided with a plurality of massage protrusions 23. In the embodiment of the present invention, two first massage rollers 22 are provided, and as shown in FIG. 3, the two first massage rollers 22 are rotatably arranged on the roller carrier 21 side by side. When using the hula hoop, a user twists the waist to contact the first massage roller 22, thus forming a pressing type massage on the waist of the human body; meanwhile, the first massage roller 22 rotates on the roller carrier 21 due to the contact of the waist of the user, thus forming a transverse kneading massage on the waist of the human body; in addition, the massage protrusion 23 further enhances a massage effect on the waist of the human body, and increases a friction force during contact with the human body, such that the first massage roller 22 is easier to rotate on the roller carrier 21, the massage effect is better, and meanwhile, an antislip effect is achieved, thus preventing the hula hoop from falling off in use of the user.

A damping device configured to absorb shocks when the first kneading device transversely kneads and massages the waist of the human body is provided between the roller carrier 21 and the connecting piece 11. The damping device includes: an accommodating groove 31 provided at the connecting piece 11 and configured to be slidably connected with the roller carrier 21; and an elastic part 34 provided in the accommodating groove 31, located between the roller carrier 21 and the accommodating groove 31 and configured to absorb the shocks when the kneading device transversely kneads and massages the waist of the human body. In the embodiment of the present invention, the elastic part 34 is configured as a spring, when the user uses the hula hoop and twists the waist to contact the first kneading device, the elastic part 34 is provided to reduce shocks, thus reducing a pressure of the waist of the human body in contact with the first kneading device in a large-force twisting process, preventing injury of the waist of the human body caused by an excessive force during contact with the first kneading device, and enhancing a use safety of the user.

A damping limiting device configured to prevent the roller carrier 21 from being separated from the accommodating groove 31 when the roller carrier 21 slips outwards in the accommodating groove 31 is provided between the accommodating groove 31 and the roller carrier 21. The damping limiting device includes: a limiting block 32 fixedly provided on the roller carrier 21 and configured to prevent the roller carrier 21 from being separated from the accommodating groove 31 when the roller carrier 21 slips outwards in the accommodating groove 31; and a limiting hole 33 formed in the accommodating groove 31 and configured to be fitted with the limiting block 32 for limitation. The limiting block 32 and the limiting hole 33 are fitted for limitation, thus preventing the first kneading device from being separated from the connecting piece 11 in a use process, and guaranteeing normal use of the damping device.

A through arc-shaped chute 121 is formed in a side of the connecting piece 11 apart from the waist of the human body in a circumferential direction thereof, and the plural arc-shaped chutes 121 are connected end to end, so as to form an annular chute 12.

A counterweight device is slidably connected on the hula hoop body 1 at the annular chute 12. The counterweight device includes: a counterweight connecting piece 41 slidably provided on the hula hoop body 1 at the annular chute 12; a sliding part provided on the counterweight connecting piece 41 and configured to drive the counterweight connecting piece 41 to slide and displace on the hula hoop body 1 at the annular chute 12; a counterweight assembly 44 detachably connected with the counterweight connecting piece 41; and at least one second kneading device detachably provided at an end of the counterweight connecting piece 41 close to the waist of the human body, and configured to transversely knead and massage the waist of the human body when the counterweight connecting piece 41 slides on the hula hoop body 1 at the annular chute 12. The second kneading device includes: a connecting frame 42 provided at the end of the counterweight connecting piece 41 close to the waist of the human body; and a second massage roller 43 rotatably provided on the connecting frame 42. The second massage roller 43 is provided with a plurality of massage protrusions 23.

Figure 5:
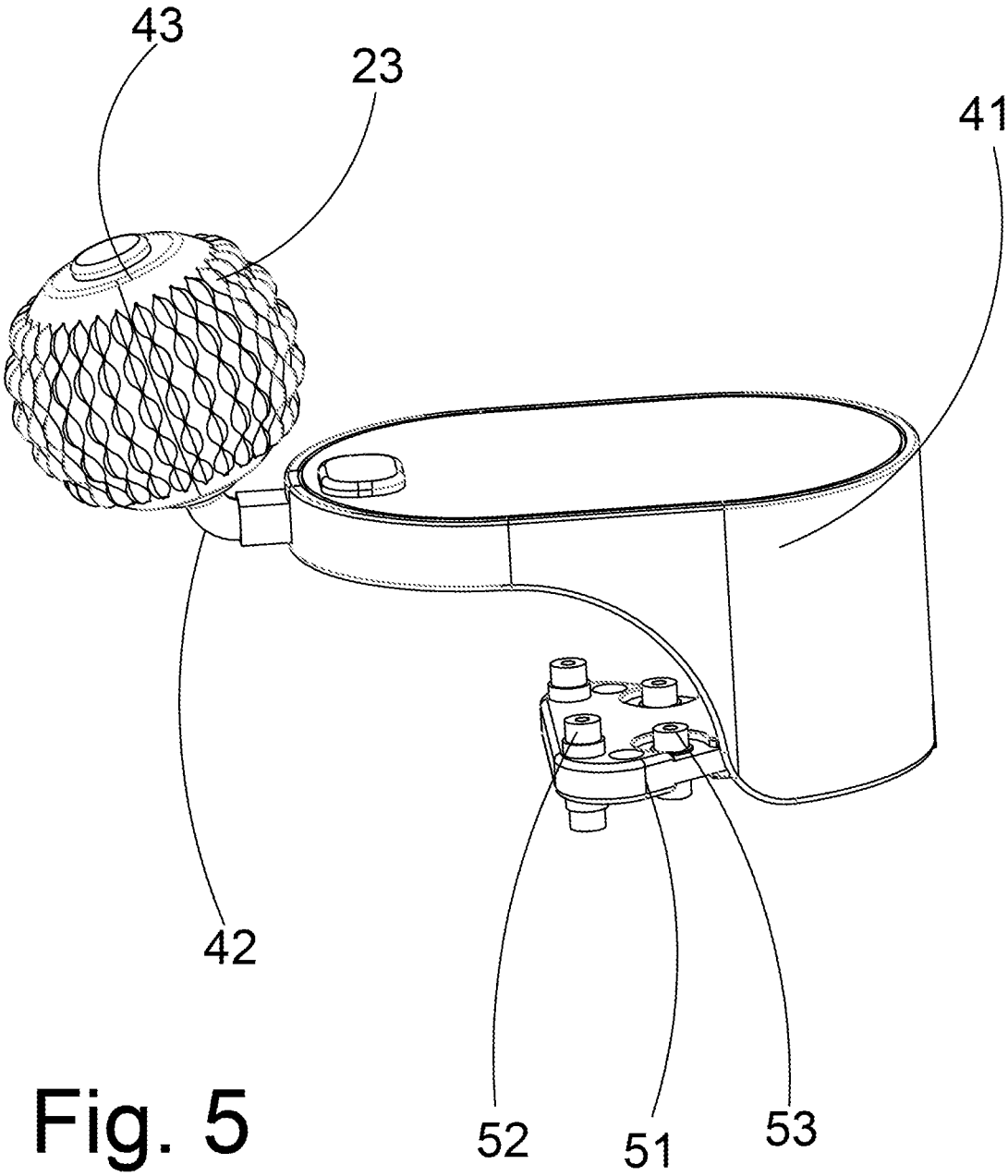
FIG. 5 is a schematic partial structural diagram of a counterweight device according to the embodiment of the present invention.

In the embodiment of the present invention, as shown in FIG. 5, one second kneading device is provided, and the user mounts the counterweight device to the hula hoop body 1 with the second kneading device in an upward or downward direction as required, so as to transversely knead and massage the waist of the human body above or below the hula hoop when the user wears the hula hoop.

In the embodiment of the present invention, the counterweight assembly 44 may be detachably connected with the counterweight connecting piece 41 by a connecting rope 45, and the counterweight assembly 44 is configured as a counterweight ball or a device configured to increase a counterweight feeling of the user when the counterweight device slides in the annular chute 12 following the action of the user, such as a swinging weight, or the like.

As shown in FIG. 5, the sliding part includes: a slippage connecting block 51 provided on the counterweight connecting piece 41 and configured to extend into the hula hoop body 1 from the annular chute 12; and a rotating wheel set rotatably provided on the slippage connecting block 51 and configured to abut against the hula hoop body 1 to drive the counterweight connecting piece 41 to slide on the hula hoop body 1 at the annular chute 12. The rotating wheel set includes: at least one inner rotating wheel set 51 symmetrically provided on the slippage connecting block and configured to abut against an inner wall of the hula hoop body 1 to rotate; and at least one outer rotating wheel set 53 symmetrically provided on the slippage connecting block and configured to abut against an outer wall of the hula hoop body 1 to rotate. In the embodiment of the present invention, each of the inner rotating wheel set 52 and the outer rotating wheel set 53 includes two rotating wheels provided at an upper end surface and a lower end surface of the slippage connecting block 51 respectively; the inner rotating wheel set 52 is fitted with the outer rotating wheel set 53, such that the counterweight connecting piece 41 may better fit and slide on the hula hoop body 1, and an anti-falling effect is achieved.

As shown in FIG. 2, a connecting-piece limiting device is provided between every two adjacent connecting pieces 11, and the connecting-piece limiting device includes: two limiting plates 15 provided at one end of the connecting piece 11 and located on two sides of the arc-shaped chute 121 respectively; and two limiting grooves 16 provided at the other end of the connecting piece 11 and located on the two sides of the arc-shaped chute 121 respectively. During the connection of two adjacent connecting pieces 11, the two limiting plates 15 of one connecting piece 11 are correspondingly clamped into the two limiting grooves 16 of the other connecting piece 11, so as to limit the two adjacent connecting pieces; by the connecting-piece limiting device, the two adjacent connecting pieces may be better aligned when connected, and meanwhile, rotation between the two adjacent connecting pieces is limited to prevent an influence on use caused by deformation of the whole hula hoop due to an overlarge rotation amplitude.

In the present invention, every two adjacent connecting pieces are detachably connected by an engagement connecting device or a quick-release connecting device.

When an engagement connecting device is adopted, as shown in FIG. 2, the engagement connecting device includes: two hinged columns 13 provided at one end of the connecting piece 11; and two hinged grooves 14 provided at the other end of the connecting piece 11 and configured to be fitted and connected with the two hinged columns 13. During the connection of two adjacent connecting pieces 11, the two hinged columns 13 on one connecting piece 11 are correspondingly clamped into and hinged to the two hinged grooves 14 on the other connecting piece 11.

Figure 6:
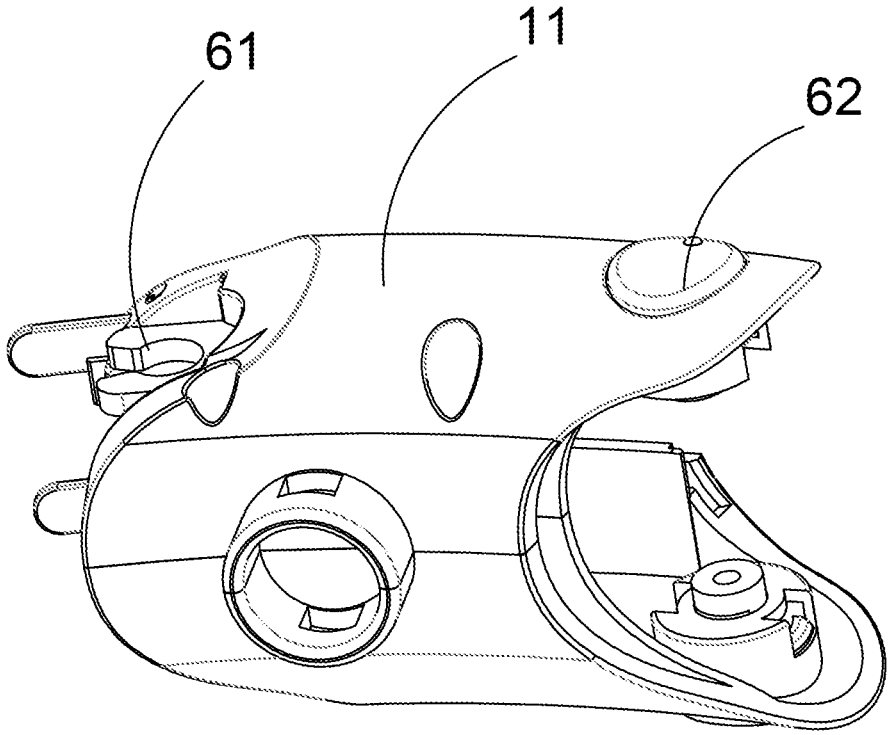
FIG. 6 is a schematic structural diagram of the connecting piece configured as a quick-release connecting device according to the embodiment of the present invention.

When a quick-release connecting device is adopted, as shown in FIG. 6, the quick-release connecting device includes: two engaging blocks 61 provided at one end of the connecting piece 11; and two quick release buttons 62 provided at the other end of the connecting piece 11 and configured to be fitted and connected with the two engaging blocks 61 respectively. During the connection of two adjacent connecting pieces 11, the two engaging blocks 61 on one connecting piece 11 are correspondingly clamped into and engaged with the two quick release buttons 62 on the other connecting piece 11.

Figure 7:
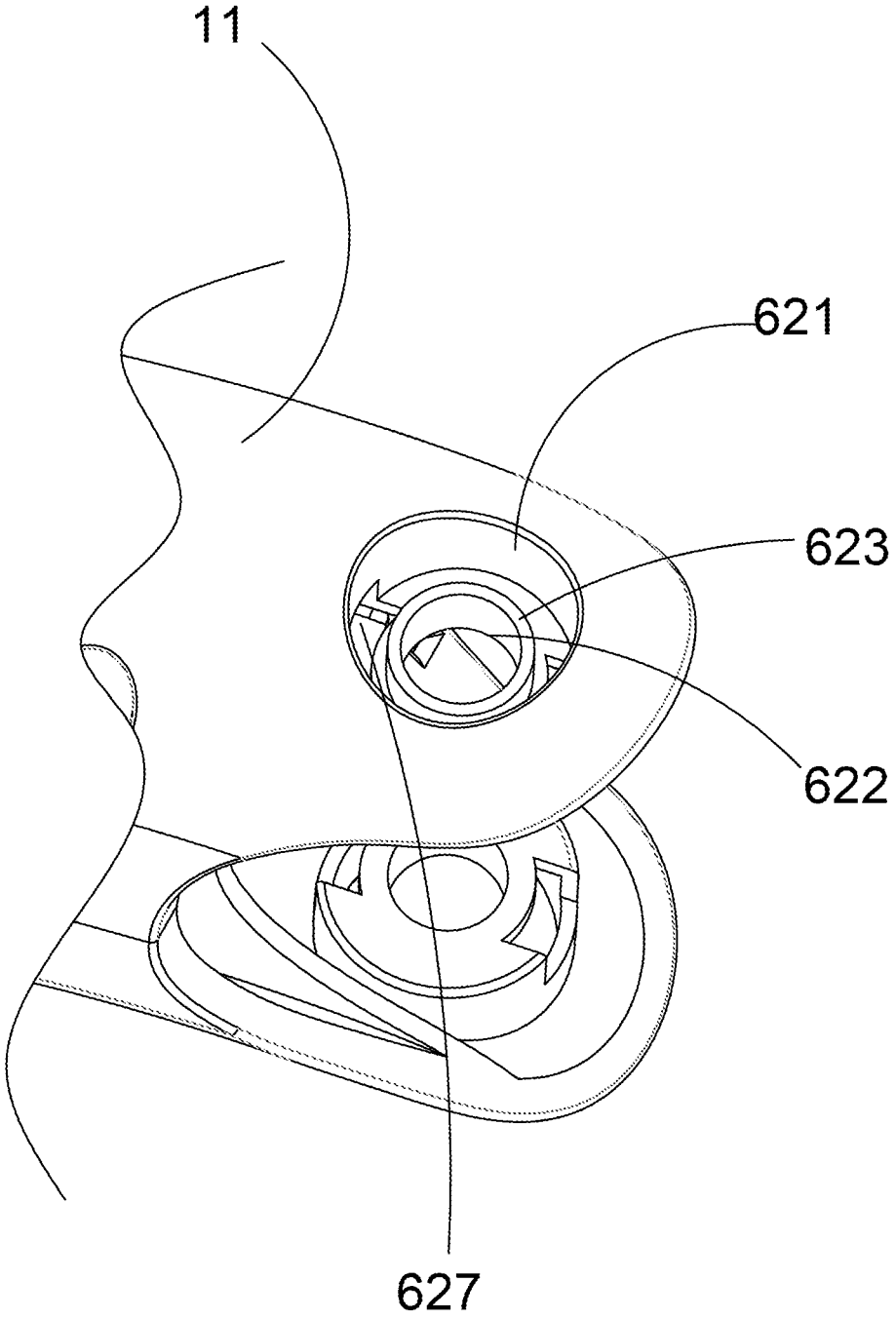
FIG. 7 is a schematic structural diagram of a button groove according to the embodiment of the present invention.
Figure 8:
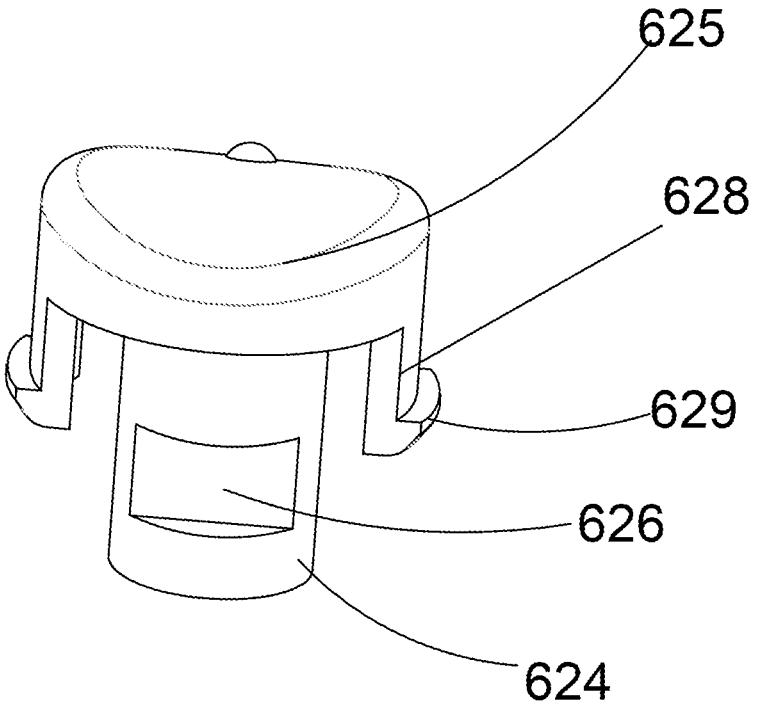
FIG. 8 is a schematic structural diagram of a button according to the embodiment of the present invention.
Figure 9:
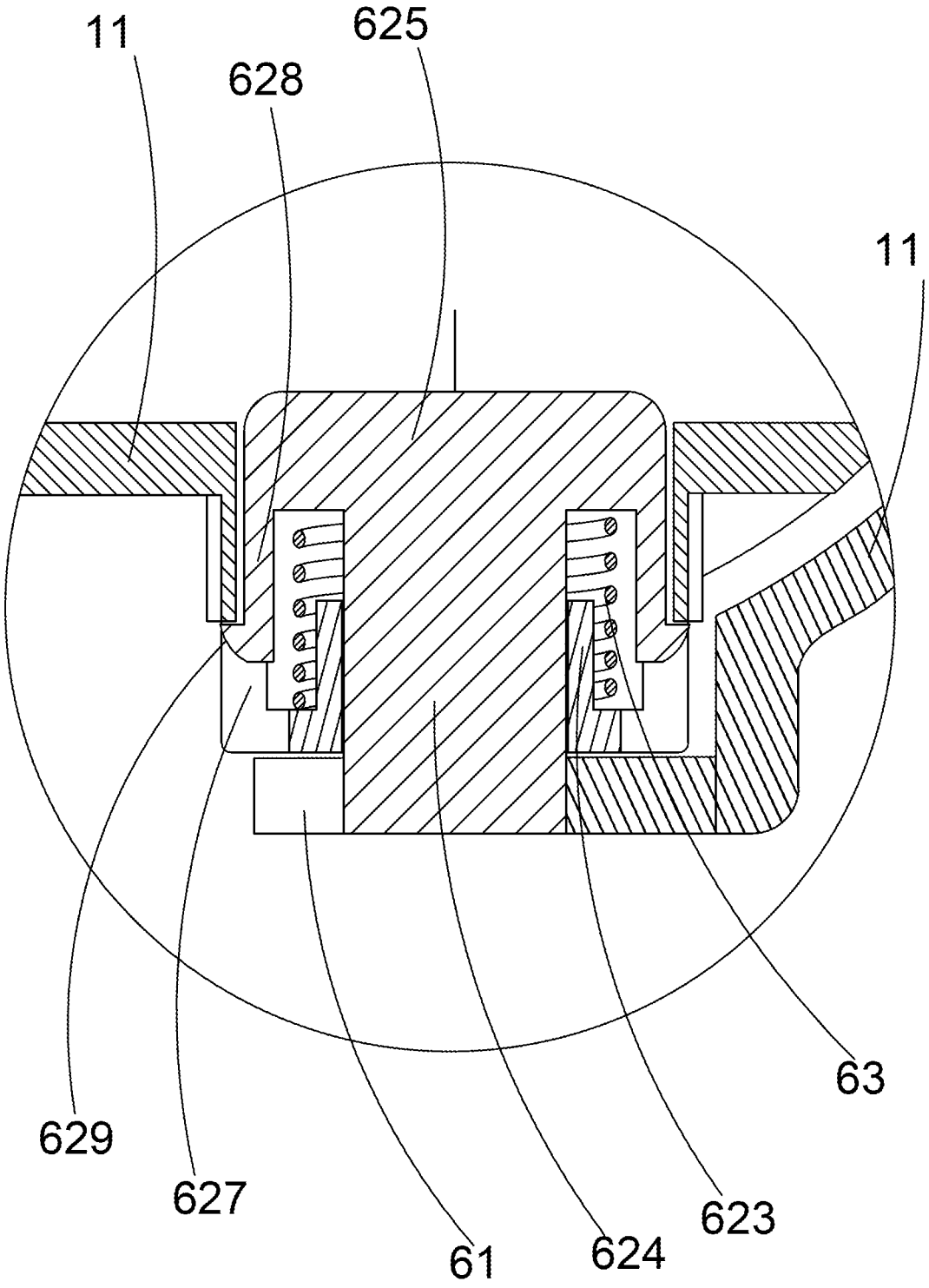
FIG. 9 is a schematic sectional structural diagram of a connection of the quick-release connecting device according to the embodiment of the present invention.

As shown in FIGS. 7 to 9, the quick release button 62 includes: a button groove 621 provided at the connecting piece; a through hole 622 provided at a bottom of the button groove 621; a button slidably provided at the button groove 621 and located at the through hole 622; a return spring 63 provided between the button groove 621 and the button and configured to lift and return the button after the button is pressed; and a button limiting device provided between the button groove 621 and the button and configured to prevent the button from being separated from the button groove when the button slips outwards in the button groove. A periphery of the through hole 622 is provided with an annular guide plate 623 configured to guide the button sliding on the through hole 622. The button includes: a button column 624 slidably provided at the button groove 621 and located at the through hole 622; a button block 625 fixedly provided at an upper end of the button column 624; and an engaging groove 626 provided at the button column 624 and configured to clamp the engaging block 61 into the button column 624 after the button is pressed. During the connection of two connecting pieces 11, the button block 625 on one connecting piece 11 is pressed, the engaging groove 626 on the button column 624 is exposed from the through hole 622 as the button column 624 descends, the button column 624 is then clamped at the engaging groove 626 using the engaging block 61 on the other connecting piece 11, the button is reset after released, the button column 624 ascends and is reset, and a part of the button column 624 below the engaging groove 626 is in clearance fit with the engaging block 61, thereby completing the connection of the two connecting pieces 11. The button limiting device includes: two button limiting parts provided at a bottom of the button block 625 and located at the button column 624; and button limiting holes 627 formed in two side walls of the button groove 621 and configured to be fitted with the two button limiting parts, the button limiting part including a limiting connecting plate 628 provided at the bottom of the button block 625 and a limiting projection 629 provided at the limiting connecting plate 628 and configured to be fitted with the button limiting hole 627.

The working principle is as follows.

The user adjusts a number of the connecting pieces 1 according to actual use requirements, such that a size and a length of the hula hoop body 1 better fit the user; when using the hula hoop, the user twists the waist, the counterweight device slides in the annular chute 12 following the action of the user, the second kneading device in the counterweight device also moves around the waist of the user with the counterweight device, and the second massage roller 43 continuously massages the waist of the user; meanwhile, when the user twists the waist, the first massage roller 22 in the first kneading device on the connecting piece 11 rolls and contacts the waist continuously due to the twisting action of the waist of the user, so as to massage the waist based on a waist twisting frequency of the user.

The above shows and describes the basic principles, main features and advantages of the present invention. Those skilled in the art should understand that the present invention is not limited by the above-mentioned embodiments. The above-mentioned embodiments and descriptions only illustrate the principles of the present invention. Without departing from the spirit and scope of the present invention, the present invention will have various changes and improvements, these changes and improvements fall within the scope of the claimed invention, and the scope of protection claimed by the present invention is defined by the appended claims and their equivalents.

What is claimed is:

1. A swinging hula hoop, comprising a hula hoop body, the hula hoop body comprising a plurality of connecting pieces detachably connected end to end, wherein a first side of one of the plurality of connecting pieces adapted to face the waist of a human body is provided with a first kneading device configured to transversely knead and massage the waist of the human body when the hula hoop is used;

the first kneading device comprises: a roller carrier provided on a surface of the first side of one of the plurality of connecting pieces; and at least one first massage roller rotatably provided on the roller carrier and configured to transversely knead and massage the waist of the human body;

the first massage roller is provided with a plurality of massage protrusions;

a damping device configured to absorb shocks when the first kneading device transversely kneads and massages the waist of the human body is provided between the roller carrier and one of the plurality of connecting pieces;

the damping device comprises: an accommodating groove provided at the connecting piece and configured to be slidably connected with the roller carrier; and an elastic part provided in the accommodating groove, located between the roller carrier and the accommodating groove and configured to absorb the shocks when the kneading device transversely kneads and massages the waist of the human body;

a plurality of through arc-shaped chutes are formed on the plurality of connecting pieces; each of the plurality of through arc-shaped chutes is formed on a second side of one of the plurality of connecting pieces, the second side being adapted to apart from the waist of the human body; the plurality of through arc-shaped chutes formed on the plurality of connecting pieces are connected end to end, so as to form an annular chute; and a counterweight device is slidably connected on the hula hoop body at the annular chute;

wherein the counterweight device comprises: a counterweight connecting piece slidably provided on the hula hoop body at the annular chute; a sliding part provided on the counterweight connecting piece and configured to drive the counterweight connecting piece to slide and displace on the hula hoop body at the annular chute; a counterweight assembly detachably connected with the counterweight connecting piece; and at least one second kneading device detachably provided at an end of the counterweight connecting piece adapted to face the waist of the human body, and configured to transversely knead and massage the waist of the human body when the counterweight connecting piece slides on the hula hoop body at the annular chute;

the second kneading device comprises: a connecting frame provided at the end of the counterweight connecting piece facing the waist of the human body; and a second massage roller rotatably provided on the connecting frame.

2. The swinging hula hoop according to claim 1, wherein a damping limiting device configured to prevent the roller carrier from being separated from the accommodating groove when the roller carrier slips outwards in the accommodating groove is provided between the accommodating groove and the roller carrier;

the damping limiting device comprises: a limiting block fixedly provided on the roller carrier and configured to prevent the roller carrier from being separated from the accommodating groove when the roller carrier slips outwards in the accommodating groove; and a limiting hole formed in the accommodating groove and configured to be fitted with the limiting block for limitation.

3. The swinging hula hoop according to claim 1, wherein the second massage roller is provided with a plurality of massage protrusions.

4. The swinging hula hoop according to claim 1, wherein the sliding part comprises: a slippage connecting block provided on the counterweight connecting piece and configured to extend into the hula hoop body from the annular chute; and a rotating wheel set rotatably provided on the slippage connecting block and configured to drive the counterweight connecting piece to slide on the hula hoop body at the annular chute.

5. The swinging hula hoop according to claim 4, wherein the rotating wheel set comprises: at least one inner rotating wheel set symmetrically provided on the slippage connecting block and configured to abut against an inner wall of the hula hoop body to rotate; and at least one outer rotating wheel set symmetrically provided on the slippage connecting block and configured to abut against an outer wall of the hula hoop body to rotate.

6. The swinging hula hoop according to claim 1, wherein a connecting-piece limiting device is provided between every two adjacent connecting pieces, and the connecting-piece limiting device comprises: two limiting plates provided at one end of the connecting piece and located on two sides of the arc-shaped chute respectively; and two limiting grooves provided at the other end of the connecting piece and located on the two sides of the arc-shaped chute respectively.

7. The swinging hula hoop according to claim 1, wherein every two adjacent connecting pieces are detachably connected by a quick-release connecting device;

the quick-release connecting device comprises: two engaging blocks provided at a first end of one of the plurality of connecting pieces; and two quick release buttons provided at a second end of one of the plurality of connecting pieces and configured to be fitted and connected with the two engaging blocks respectively.

8. The swinging hula hoop according to claim 7, wherein the engagement connecting device comprises: two hinged columns provided at one end of the connecting piece; and two hinged grooves provided at the other end of the connecting piece and configured to be fitted and connected with the two hinged columns.

* * * * *